US005893261A

United States Patent [19]

Ribi et al.

[11] Patent Number: 5,893,261

[45] Date of Patent: Apr. 13, 1999

[54] DEVICE FOR SEALING CONTAINER OPENINGS BY APPLYING STRETCH PLASTIC FILM

[75] Inventors: Léon A. Ribi; Guido Ribi, both of Montreux, Switzerland

[73] Assignees: Leon Ribi, Montreux, Switzerland; World Wide Sealing Corp., Panama City, Panama

[21] Appl. No.: 08/894,241

[22] PCT Filed: Jan. 29, 1996

[86] PCT No.: PCT/EP96/00342

§ 371 Date: Oct. 30, 1997

§ 102(e) Date: Oct. 30, 1997

[87] PCT Pub. No.: WO96/23702

PCT Pub. Date: Aug. 8, 1996

[30] Foreign Application Priority Data

Jan. 30, 1995 [CH] Switzerland ..... 235/95

[51] Int. Cl.[6] ..... B65B 53/00; B65B 7/28

[52] U.S. Cl. ..... 53/441; 53/556; 53/342; 53/390; 53/488

[58] Field of Search ..... 53/441, 556, 48.3, 53/48.4, 293, 294, 341, 342, 343, 357, 359, 363, 366, 390, 389.3, 550, 219, 478, 485

[56] References Cited

U.S. PATENT DOCUMENTS

| | | | |
|---|---|---|---|
| 2,008,802 | 7/1935 | Stanek et al. | 53/357 |
| 3,321,103 | 5/1967 | Phillips | 53/390 X |
| 3,519,128 | 7/1970 | Swanberg | 53/441 X |
| 4,018,034 | 4/1977 | Keren | 53/219 X |
| 4,199,917 | 4/1980 | Mitchell . | |
| 4,658,568 | 4/1987 | Reid et al. | 53/441 X |
| 5,312,031 | 5/1994 | Thelen et al. | 53/389.3 X |

FOREIGN PATENT DOCUMENTS

| | | | |
|---|---|---|---|
| 132856 | 11/1978 | Germany | 53/556 |
| 3047182 | 7/1982 | Germany . | |
| 1427935 | 3/1976 | United Kingdom | 53/556 |
| 2046694 | 11/1980 | United Kingdom | 53/390 |
| WO9411149 | 5/1994 | WIPO . | |

*Primary Examiner*—Linda Johnson

*Attorney, Agent, or Firm*—Sughrue, Mion, Zinn, Macpeak & Seas, PLLC

[57] ABSTRACT

A device for sealing container openings which uniformly applies a stretch plastic film onto the openings to be sealed. The device comprises a support, preferably flat-shaped, having at least one hole, on which is placed the stretch plastic film, the film is held taut and adherent to the support by means of gluing, magnetic force, pressure, or a counter-pattern. The device can bear a mark or a recognition message, as well as a warning or an advertisement and can also be used for temporary sealing of containers.

10 Claims, 3 Drawing Sheets

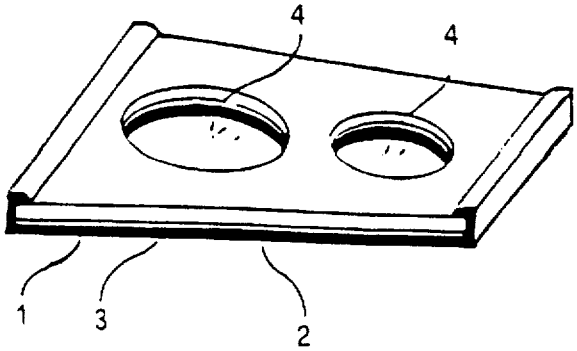
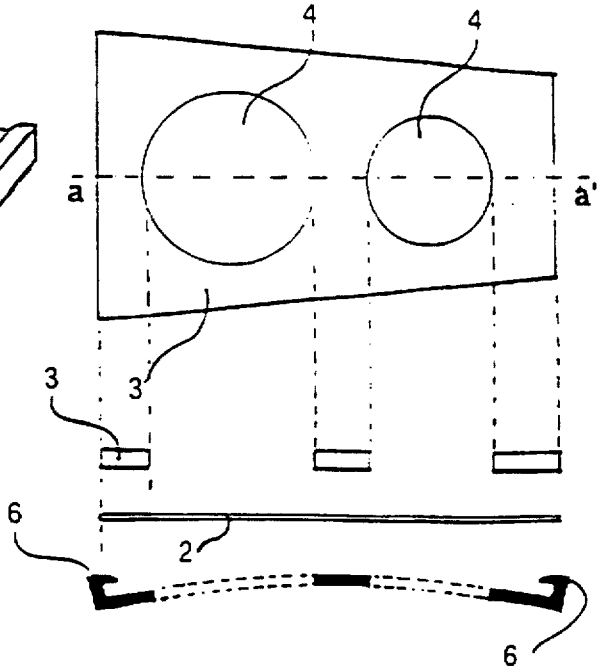
FIG. 3
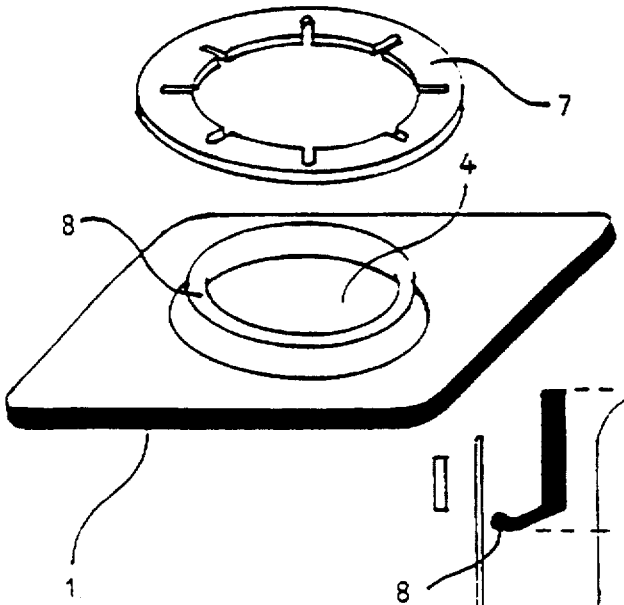
FIG. 4
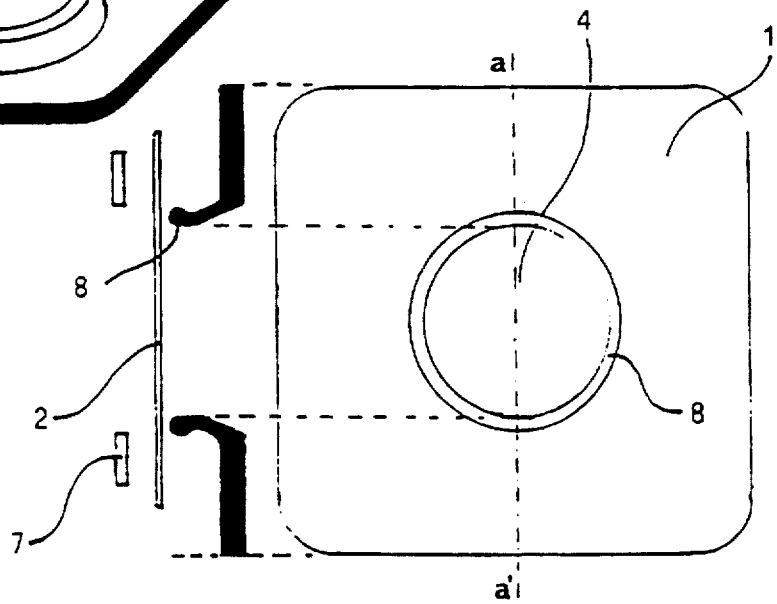

DEVICE FOR SEALING CONTAINER OPENINGS BY APPLYING STRETCH PLASTIC FILM

FIELD OF THE INVENTION

The present invention relates to a device suitable for applying a stretch plastic film of commonly used type, for example for wrapping food, onto the opening of containers in order to seal them for preservation or for long-life of their contents.

PRIOR ART DISCLOSURE

Up to now, in order to use a stretch film to seal a container, the most common procedure consists of applying by hand a stretch film of sufficient size and, after having positioned it in the best way over the container opening, a downward movement over the container opening is exerted by hand, so to make the film adhere to the opening itself; this procedure is ended up by joining together and overlapping the free edges of the film around the container opening, in order to make this "cap" stay in its place.

Obviously, this procedure lead to the waste of a lot of material; furthermore, it does not normally ensure the hygiene necessary in these cases and it does not guarantee a constant and assured adhesion of the film to the container opening. Moreover, said procedure has the great disadvantage of wasting plastic material, which is no more useful and lead to an increase of pollution.

The device which is the object of the present invention is able to avoid all these drawbacks, assuring an easy and efficient hermetic sealing with only little amounts of film.

U.S. Pat. No. 4,199,917 describes a reusable device for applying a stretch film lid to a cup, comprising a planar rigid peripheral frame and a multiplicity of finger elements extending inwardly therefrom. When said finger elements are urged against the brim of the cup, they displace upwardly, thus opening a passageway therebetween to permit the cup to pass thereinto, facilitating the film stretching. Finally, the film is released from the device, which can be reused with another length of stretch film.

SUMMARY OF THE INVENTION

The object of the present invention is a device for sealing container openings by applying a stretch plastic film; said device comprises a support having at least one hole piercing the length-width support plan and supporting said stretch plastic film; the diameter of said at least one hole is greater than the diameter of the container openings to be sealed and the stretch plastic film is placed on said at least one hole and is taut and adherent to said support.

DESCRIPTION OF THE DRAWINGS

Some embodiments ol the device according to the present invention are schematically illustrated in the following drawings:

FIG. 3 shows a perspective, a planar and a cross-sectional view of a third embodiment of the device according to the present invention, said cross-sectional view illustrating the separate parts of the device before assembling; in this figure, the support, the film and the counter-pattern are held together by means of the elastic clamps on the two opposite rims of said support.

FIG. 4 shows a perspective, a planar and a cross-sectional view of a further embodiment of the device according to the present invention, with the separate parts of the device before assembling; in this figure, the film is held adherent to the hole of the support, by means of the elastic ring embedded around the outer ring-like protrusion of the conic trunk of the hole.

DETAILED DESCRIPTION OF THE INVENTION

The characteristics and advantages of the device for sealing container openings according to the present invention will be better illustrated in the following detailed description.

According to the present invention, the membrane 2, by means of the hole-bearing support 1 to which it is held adherent, may be positioned on the opening of any container, said opening being preferably circular; then, said membrane 2 may be stretched over said opening and finally torn by the inner rim of said hole 4, by applying a sufficient pressure to the support 1, downward perpendicular to said membrane, against the opening of the container, using ones hand or a manual or mechanical applied.

As already pointed out, the device of the invention allows at the same time to keep the film 2 taut and to apply it on the opening of the container to be sealed, by exerting a sufficient pressure perpendicularly to the membrane itself and towards said opening; in this way, it is possible to make the film 2 adhere uniformly by stretching it first over the opening of the container and finally to tear it around opening itself.

Figure 1:
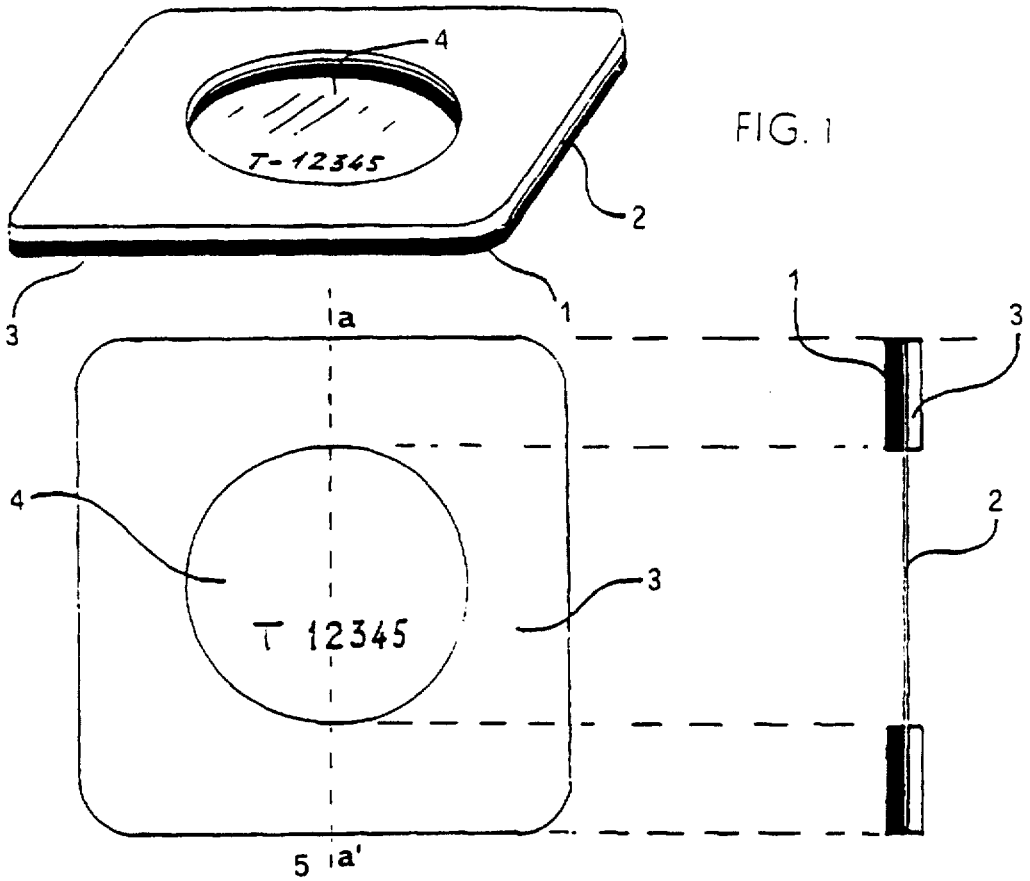
FIG. 1 shows a perspective, a planar and a cross-sectional view of a first embodiment of the device of the invention, wherein the film is held adherent to the support, having a hole, by the counter-pattern.

According to the present invention, said support 1 is preferably flat or laminar, where the length and width are much greater than thickness; the support 1 can be made of different types of material, such as cardboard, thin plastic or metal layers or composite materials. Said support 1 carries at least one hole, preferably positioned in the middle of said support 1 (FIGS. 1, 4 and 5) and having a diameter size about 20–30% greater than the diameter of the container to be sealed.

Figure 5:
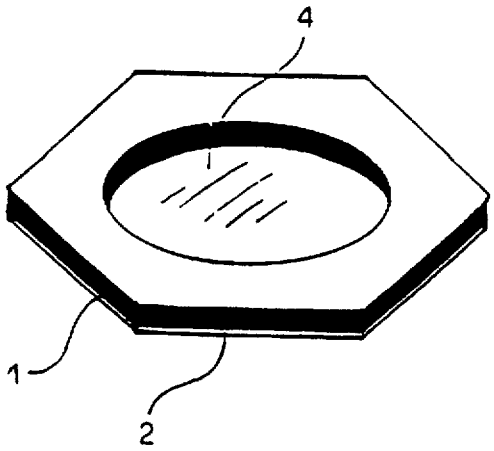
FIG. 5 shows a perspective a planar and a cross-sectional view of another embodiment of the device according to the present invention, in which the hexagonal support and the membrane are glued together.
Figure 5:
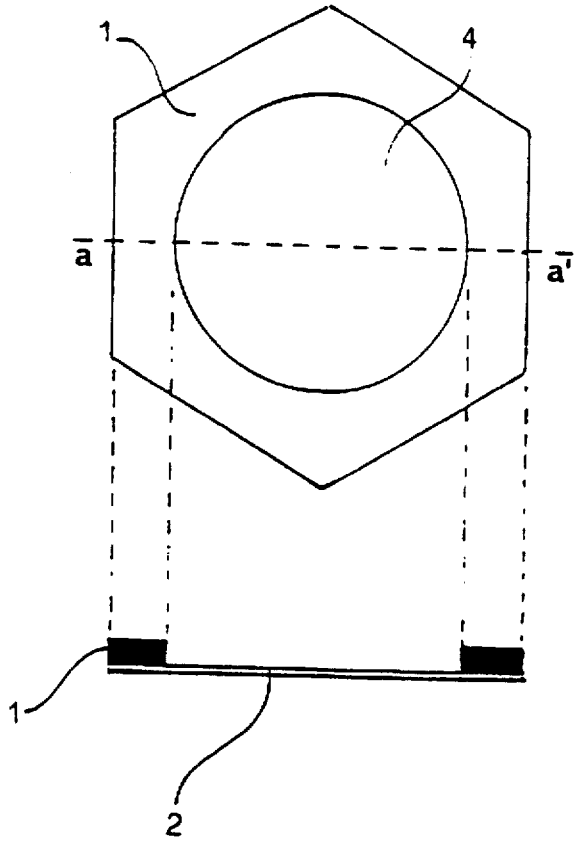
Figure 6:
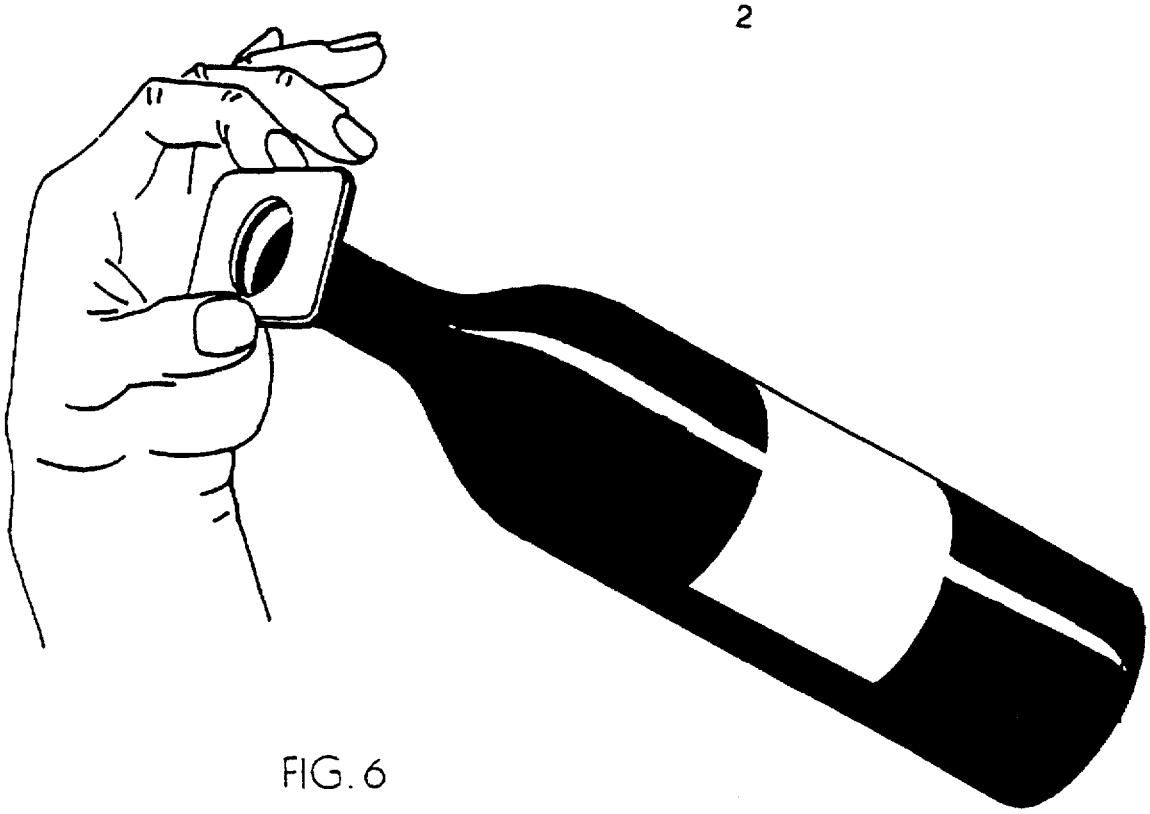
FIG. 6 shows a device according to the present invention, while being applied for sealing the opening of a bottle.

In its simplest embodiment of FIG. 5, the device of the invention comprises a polygonal support 1 made of tough cardboard, having a central hole 4 on which a sheet of said film 2 is simply glued.

An improvement of the above-mentioned embodiment (FIG. 1) is obtained by interposing a sheet of taut film 2 between two similar patterns of cardboard, having the same number of wanted holes with the same diameter and the same reciprocal position, which may be held together by gluing or by magnetic force. An efficient embodiment of the device of the invention can be obtained by applying a counter-pattern 3 on said support 1 over which the film 2 is taut and adherent, said counter-pattern 3 having the same number, diameter and disposition of holes as the support 1. The support 1 and the counter-pattern 3 may be held together by means of gluing or of magnetic force; in this last case, one of said two parts of the device is magnetised, while the other part is made of ferromagnetic material.

In the case the use of glue is not desirable, adhesion of the support 1 and the counter-pattern 3 may be obtained by means of mechanical fastenings, which may exercise sufficient pressure on the film 2 adherent to said support 1, thus holding it firmly in its place.

Figure 2:
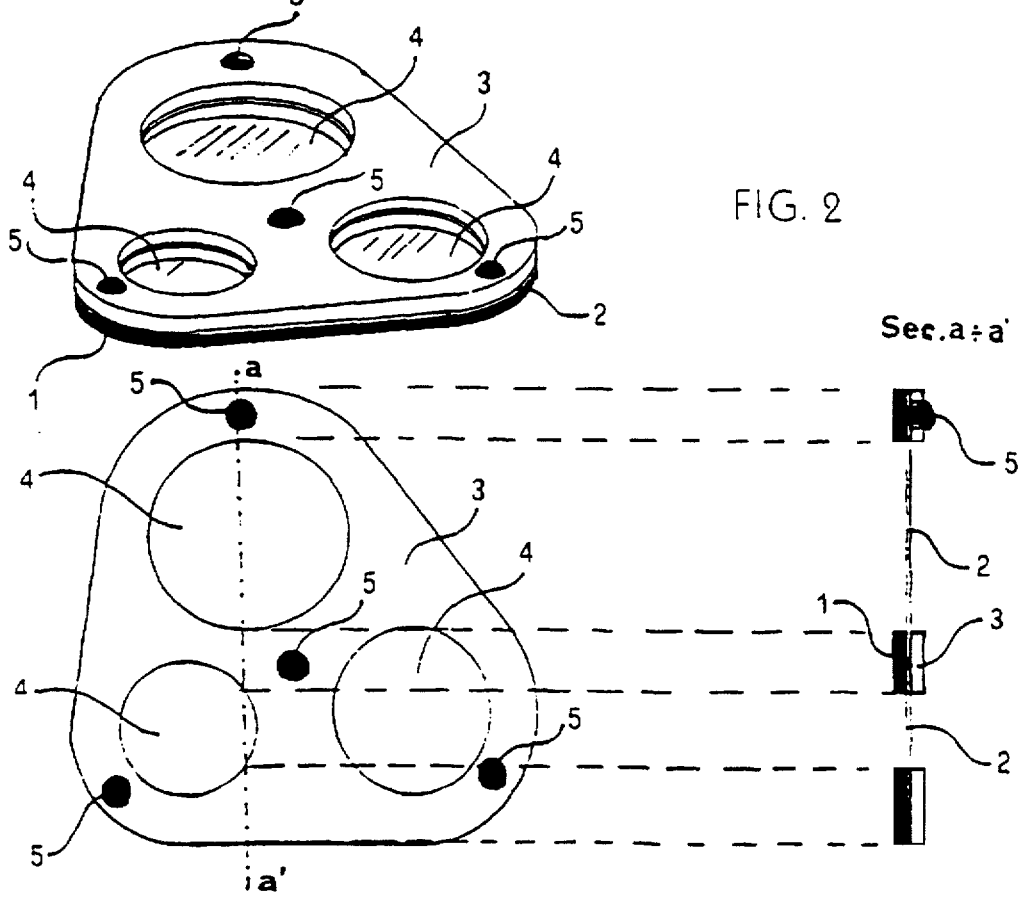
FIG. 2 shows a perspective, a planar and a cross-sectional view of a second embodiment of the device according to the present invention, wherein the support, having three circular holes of different size, the film and the counter-pattern are held together by means of mushroom-shaped protrusions of said support, which are embedded by force into the corresponding holes of the counter-pattern.

According to the embodiment of FIG. 2, said counter-pattern 3 is held adherent to said support 1 through joints consisting, on the one side, of protrusions 5 having a mushroom cross-section and, on the other side, of corresponding holes into which said protrusions 5 are embedded. The protrusions 5 and the corresponding holes may be part either of the support 1 or of the counter-pattern 3, without any distinction.

According to another embodiment of the device of the present invention (FIG. 3), the counter-pattern 3 may be held adherent to the support 1 by means of elastic clamps 6, placed along at least two opposite extreme points of the support 1 and of the counter-pattern 3. In order to increase the pressure on the interposed film 2, one of the two parts of the device, either the support 1 or the counter-pattern 3, can be arched so that the pressure exerted by the elastic reaction to this curving consents to obtain the necessary pressure on the film 2, when said two parts are clasped together. In FIG. 3, during assembling, the arched support 1 becomes straightened, thus obtaining the necessary pressure on the film 2 against the counter-pattern 3.

According to another embodiment of the device of the invention (not shown), an advantageous fastening of the film 2 to the support 1 may be obtained by means of ring-like protrusions round the holes 4 of the support 1, corresponding to ring-like hollows in the counterpart of the device.

According to a further embodiment of the device of the invention (FIG. 4), the rims of the hole 4 protrude so as to form a cone- or cylinder-trunk, the distal rim of said trunk having an internal ring-like protrusion 8. In this case, the film 2 is held adherent to the hole 4 by means of an elastic ring 7, which is embedded under the neck formed by said ring-like protrusion 8 of said cone- or cylinder-trunk.

The present invention encompasses even different embodiments in which the film 2 is kept taut and adherent to the support 1 by means of devices already known in the state of the art and employed for different purposes.

According to further embodiments as shown in FIG. 5 of the device of the invention, the film 2 can be advantageously weakened by a continuous or discontinuous removal of material along a close line 9, within which the diameter of the container opening to be sealed can be inscribed, so that the tearing of the film 2 occurs along said line.

According to further embodiments of the device of the invention, not shown, the hole 4 of the support 1 and/or of the counter-pattern 3 can have a rim with a sharp, serrated or notched profile, so that said rim tears said film 2 along said profile.

The device according to the present invention can be prepared by placing a stretch plastic film 2 on a support 1 having at least one hole, said hole being preferably circular; said film 2 may be held firmly adherent to said support 1 in the ways known in the state of the art, so that it may be applied to the support itself.

The device of the invention can be kept sterile before application by means of a suitable packing, both single and multiple.

In order to use the device according to the present invention, it is sufficient to lay the film of the device itself onto the previously cleaned and dried container opening to be sealed and subsequently to urge the device against said opening by applying with the fingers a downward pressure on said device, towards the opening or the container. After stretching, the film adheres to the container opening. Continuing the downward movement, the same film tears around the container opening and, at the end of the procedure, a taut film circle sealing the container is obtained.

Depending on the practical needs of use, the support of the device can be left around the neck of the container or it can be taken away.

Among the possible commercial uses of the device of the invention, the following possibilities are reported hereabove, with illustrative but not limitative purposes.

a) The device can be used for sealing containers of domestic use, mainly bottles of different size.

Generally, the content of bottles, after opening, is not completely used, as in the case of mineral water, wine,oil, beer, syrups, fizz drinks and the like. Therefore, the device of the invention allows an easy and hygienic resealing of all the opened containers, the content of which has been only partially used, consenting a subsequent completion after some time.

b) Another advantageous use of the device of the invention can be carried out in research institutes, analysis laboratories, cellars and drink industries, for sealing of sample-collecting containers.

c) Moreover, the device according to the present invention, when provided with suitable sterile membranes and supports, can also be used in hospitals, clinics and biomedical analyses institutes, in order to seal biological and cytological samplings, as well as microbiological or parasitary cultures contained in test-tubes or other suitable containers.

d) The device of the invention can be advantageously used not only for sealing containers, but also, at the same time, for marking the containers themselves, with the purpose of recognising the same or of delivering or leaving a message or a warning on them.

Therefore, whenever the film and/or the support are graphically marked or evidenced in relief, with either a number or a sign, it is possible to identify the sealed container. Furthermore, after sealing, the marked support, bearing the same identifying sign or number as the film applied on the sealed container, may be kept by the person who has sealed the container opening in order to recognise the property of the container itself. Such a specific use may find a widespread utilisation in canteens, hotels, hospitals, barracks, schools etc.

e) The device of the invention can be advantageously and economically used for sealing containers for public use destination, since it consents the bearing of trademarks or advertisements in general.

f) A further widespread use of the device of the invention may consist in supplying a temporary sterile and quick hermetic sealing, prior to the final sealing of containers by means of other closing devices, such as screw cars, capsules, caps etc. In this way, besides assuring a hygienic sealing, the film, when marked, may also guarantee the sealing date and the checking of content integrity.

The device of the invention can be applied both in common ways, in the case of few, containers to be sealed, and mechanically, during the bottling final step.

We claim:

1. A disposable device for sealing an opening of a container by means of a stretch plastic film, the device comprising a substantially flat peripheral support with at least one hole adapted to be fitted over the container opening and a film firmly retained by and secured to said support and extending across said at least one hole whereby upon pressing said support downwardly over said container opening, the film will contact and be stretched over the opening prior to tearing about the periphery of said opening leaving a taut film firmly adhered to said container and sealing said opening.

2. A disposable device as set forth in claim 1, wherein said film is secured to said support by means of glue.

3. A disposable device as set forth in claim 1, wherein said film is held adherent to said support by means of at least one counter-pattern integral with said support and having an identical number and disposition of holes as said support.

4. A disposable device as set forth in claim 3, wherein said film and support and said counter-pattern are secured together by means of glue.

5. A disposable device as set forth in claim 3, further comprising magnetic means for holding said support and said counter-pattern together.

6. A disposable device as set forth in claim 3, further comprising connecting means for holding said counter-pattern and said support together, said connecting means being comprised of at least a protrusion having a mushroom-shaped cross-section and a corresponding hole into which said at least one protrusion is imbedded, one portion of said connecting means being part of said support and the other part of said connecting means being part of said counter-pattern.

7. A disposable device as set forth in claim 3, further comprising elastic clamp means for engaging opposing side edges of said support and counter-pattern, said elastic means and said support being deformable to enable gripping of said edges by said elastic clamp means and to produce an elastic reaction to hold the film adherent to the support.

8. A disposable device as set forth in claim 1, wherein a rim of the hole of the support has a cone-trunk protrusion extending therefrom, said protrusion having an axis perpendicular to said hole and a free ring having at least one external ring-shaped bulge and further comprising elastic ring means fitted over said protrusion and secured under said ring-shaped bulge to hold said film over said protrusion.

9. A disposable device as set forth in claim 1, wherein said film is provided with a weakened closed line extending adjacent said periphery of said opening.

10. A method for adhering a sheet of stretch plastic film over a container opening comprising securing said plastic film to a flat support having at least one hole therethrough adapted to pass over said container opening, urging said plastic film into engagement with a rim surrounding said hole by pressing said support downwardly over said container opening until said plastic film secured to said flat support separates from said sheet along a line adjacent a periphery of said container opening.

* * * * *